US006120657A

United States Patent [19]

Billman

[11] Patent Number: 6,120,657

[45] **Date of Patent: *Sep. 19, 2000**

[54] DEVICE FOR TRANSMITTING ELECTRIC CURRENT TO DISC ELEMENTS IN SURFACE-COATING THEREOF

[75] Inventor: Åke Billman, Järfälla, Sweden

[73] Assignee: Toolex Alpha AB, Sundbyberg, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/981,516

[22] PCT Filed: Jun. 26, 1996

[86] PCT No.: PCT/SE96/00843

§ 371 Date: Dec. 29, 1997

§ 102(e) Date: Dec. 29, 1997

[87] PCT Pub. No.: WO97/01657

PCT Pub. Date: Jan. 16, 1997

[30] Foreign Application Priority Data

Jun. 27, 1995 [SE] Sweden ..... 9502325

[51] Int. Cl.[7] ..... C25D 17/00

[52] U.S. Cl. ..... 204/224 R; 204/297 R

[58] Field of Search ..... 204/225, 224, 204/287, 297 R

[56] References Cited

U.S. PATENT DOCUMENTS

| | | | |
|---|---|---|---|
| 3,573,176 | 3/1971 | Laznovsky | 204/15 |
| 5,167,792 | 12/1992 | Kamitakahara et al. | 205/68 |
| 5,429,733 | 7/1995 | Ishida | 204/224 R |
| 5,522,975 | 6/1996 | Andricacos | 204/297 R |
| 5,785,826 | 7/1998 | Greenspan | 205/68 |
| 5,843,296 | 12/1998 | Greenspan | 205/68 |

FOREIGN PATENT DOCUMENTS

| | | |
|---|---|---|
| 63-134688 | 6/1988 | Japan . |
| 04009491 | 1/1992 | Japan . |
| 04120288 | 4/1992 | Japan . |

*Primary Examiner*—Kathryn Gorgos
*Assistant Examiner*—Erica Smith-Hicks
*Attorney, Agent, or Firm*—Young & Thompson

[57] ABSTRACT

A device for evenly distributed electrical current transmission to a disc element when electroplating the disc element includes a closed loop of an elongated, elastic, electrically conducting body contacting one side of the disc element at least at its outer peripheral area.

15 Claims, 1 Drawing Sheet

DEVICE FOR TRANSMITTING ELECTRIC CURRENT TO DISC ELEMENTS IN SURFACE-COATING THEREOF

BACKGROUND OF THE INVENTION

The present invention relates to a device for electroplating of disc elements, such as matrices for audio and video discs, said device comprising a housing for an electrolyte bath, the disc element being clampable in the housing in such a manner that the disc side to be plated can be in contact with the electrolyte bath while its other side is kept sealed from the electrolyte bath, and a means arranged to abut against the disc element to transmit electrical current thereto during the plating process.

In electroplating of matrices for audio and video discs it is of great importance that the current transmission to the matrix be as evenly distributed as possible around the periphery of the matrix to thereby achieve a plating layer, the thickness of which is as even and uniform as possible.

A previously known device for this purpose comprises a central hub from which there extend essentially radially a plurality of electrically conducting elements, such as antennae, strips of sheet metal or sheet metal in the form of circle sectors, which, at their distal ends, are resiliently in contact with one side of the matrix at its outer peripheral area. Thus, a certain number of contact points are obtained distributed around the periphery of the matrix. One problem which can occur in such a design is that current concentrations can be formed at the contact points between the electrically conducting elements and the matrix disc, as a result of microstructural uneven areas in the matrix disc, which can create bums in the disc and thus unevenness in both the disc and the layer thickness in the surface coating obtained.

JP-A-63-134 688 shows a device for producing a press matrix, with a plating carried out on a metal layer with signal information on a glass substrate. An elastic, electrically conducting central washer is placed on the electrolyte bath side and conducts current to the central portion of the metal layer without damage thereto when the center screw is tightened.

SUMMARY OF THE INVENTION

A primary purpose of the present invention is to suggest a solution which removes the above mentioned problems and which thus makes possible an even and dense current transmission to the matrix disc, regardless of any macro- or micro-unevennesses therein.

A purpose of the present invention is also to achieve a current transmission device which makes possible both an even current transmission and thus even heat distribution, and a radially and axially resilient tensioning of the disc during the plating process, thus avoiding mechanical stresses in the disc due to thermal movements.

In accordance with the present invention, the device described by way of introduction is characterized in that the current-transmitting means comprises at least one closed loop of an elongated, elastic, electrically conducting body arranged to be in contact with at least one side of the disc element at least at its outer peripheral area, said loop being placed so that it is sealingly separated from the electrolyte bath. There is thereby achieved in electroplating of disc matrices a very even, pliable and flexible clamping of the disc, thus assuring a favourable distribution of current and force on the disc. Both macro- and micro-unevennesses can be absorbed by the elastic, electrically conducting body, thereby resulting in a very even thickness of the disc-coating layer. By virtue of the fact that the electrically conducting body is also sealingly separated from the electrolyte bath, it is not itself subjected to any electroplating and therefore can be reused a great number of times.

The elastic, electrically conducting body can be made in many different ways within the scope of the invention.

BRIEF DESCRIPTION OF THE DRAWINGS

The invention will be described in more detail below with reference to the accompanying drawing, in which.

DESCRIPTION OF THE PREFERRED EMBODIMENTS

Figures 1, 2A, 2B, 2C:
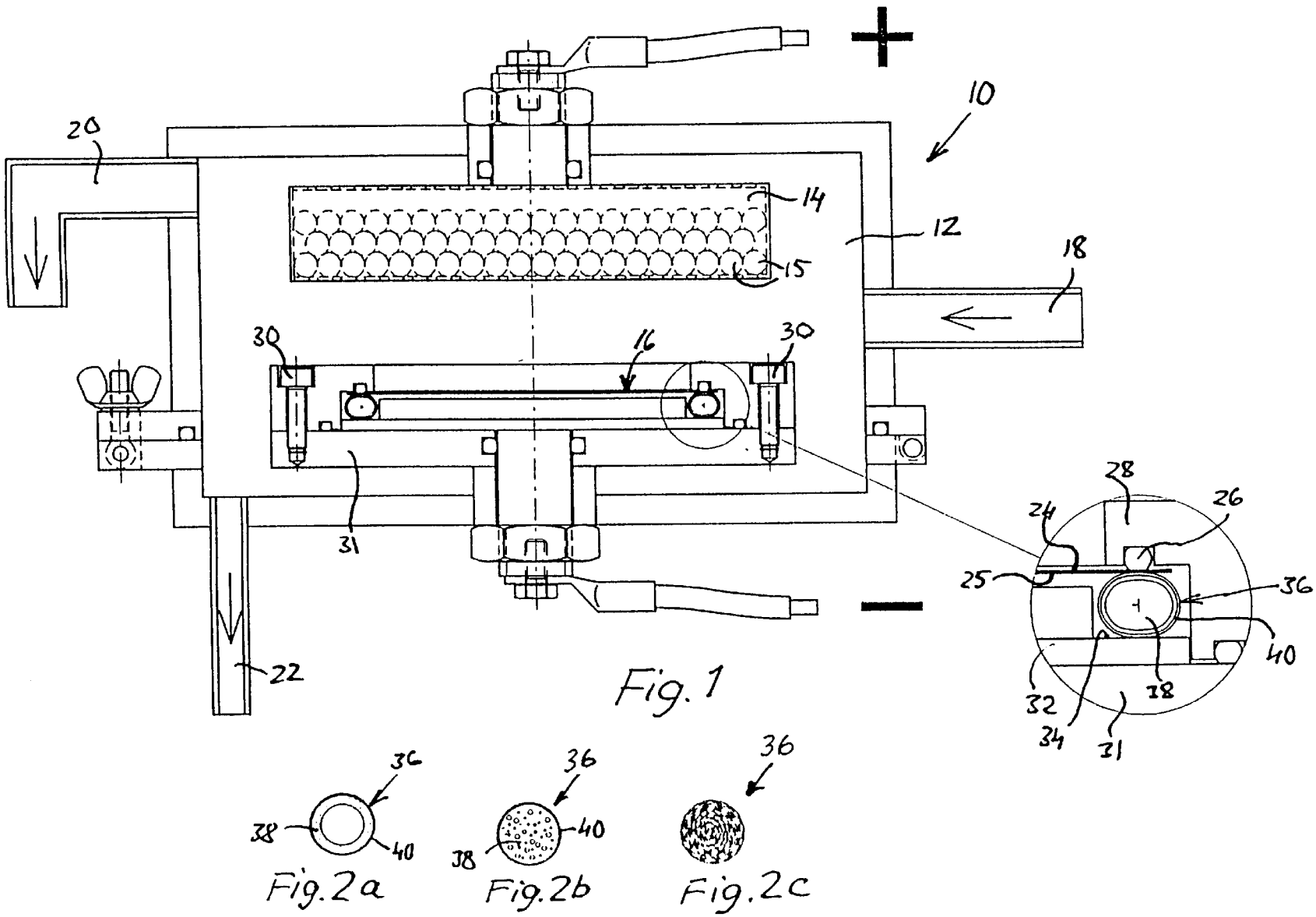
FIG. 1 is a cut-away sideview of an electroplating apparatus in which a current-transmitting device according to the invention is used, with a separate partial magnification (shown within a circle) of the contact area between the current-transmitting body and a matrix disc.
FIG. 2*a* shows a cross section through a first embodiment of the elastic, electrically conducting body according to the invention.
FIG. 2*b* shows a cross section through a second embodiment of the elastic, electrically conducting body.
FIG. 2*c* shows a cross section through a third embodiment of the current-transmitting body according to the invention.

FIG. 1 shows an apparatus, generally designated 10, for electroplating of matrix discs of metal for production of audio and video discs. The apparatus comprises a housing 12, which encloses an electrolyte bath. In the bath there is a perforated anode basket 14 containing balls 15 of the metal with which a matrix disc 16 is to be coated, e.g. nickel. The anode basket 14 is connected to a positive pole of an electrical current supply circuit. The numerals 18, 20 and 22 designate the inlet and outlets for the electrolyte.

The matrix disc 16 is clamped in the apparatus 10 by means of a holder in such a manner that one side 24 thereof, which is to be plated, is in contact with the electrolyte bath, while its other side 25 is sealed from the electrolyte bath by means of an O-ring 26 in an electrically insulating detainer ring 28, which is fixed by means of electrically insulating screws 30, for example, to an underlying bottom plate 31. On the bottom plate 31 there is supported a current conductor plate 2 with a peripheral margin 34 on which there is supported a current-transmitting means in the form of an elastic, electrically conducting body 36 according to the invention. The elastic body 36 has the form of a closed, annular loop which is arranged to conduct electric current between the "dry" side 25 of the matrix disc 16 and the current conductor plate 32 during the electroplating process. The matrix disc 16 and the current conductor 32, which are connected to the negative pole of the electrical current supply circuit, form a cathode in the electroplating process.

According to a first embodiment of the elastic body 36 according to the invention, this consists of a core 38 of elastic material, for example an elastomer, such as silicon rubber, neoprene rubber or the like. The elastic core 38 can be hollow. i.e. it can be in the form of a hose, as is shown in FIG. 2*a*, or be solid, as is shown in FIG. 2*b*. Around the core 38 in FIGS. 2*a* and 2*b*, there is applied one or more layers of a fine metal net 40 of electrically conducting material, e.g. stainless steel. The elastic core 38 provides the elastic body 36 with the desired resilience in the required directions to permit a certain compression of the elastic body 36 and thus an intimate contact surface between the metal net casing 40 and the matrix disc 16, when the detainer ring 28 via the O-ring 26 clamps the matrix disc 16 against the current-distributing elastic body 36 (see in particular the encircled magnified portion in FIG. 1). The fine metal net 40 with its resilient elastic core 38 thus assures a very good and dense contact between the matrix disc 16 and the metal net 40, which means that both macro-unevenness, e.g. warping and non-planarness, and micro-unevenness, e.g. bumps and particle formations on the disc, can be compensated for by the electrically conducting metal net 40. The large number of small contact points between the metal net structure 40 and the matrix disc 16 also provides a more even heat distribution than what was previously known within this area of technology.

Furthermore, this elastic, electrically conducting elastic body 36 provides a looser and more resilient clamping of the matrix disc than traditional technology in the field, and thus the matrix disc 16 is provided with a certain possibility of moving during the surface-coating process, as heat develops, which substantially reduces the mechanical stresses in the matrix disc 16.

According to a second conceivable embodiment of the elastic body 36 according to the invention, it can consist in its entirety of windings of fine metal netting of electrically conducting material, as is shown schematically in FIG. 2*c*, even though the elasticity is not as good in this case.

FIGS. 2*a–c* show the cross section of the elastic body 36 in the unloaded state and is in this case circular. In a loaded, clamped state, the cross section is oval, as is shown in FIG. 1. Although not shown in the drawing, it is, however, conceivable that the cross sectional shape of the elastic body 36 can have another configuration in the unloaded state than circular, e.g. oval, square or the like.

According to a third conceivable embodiment, the elastic, electrically conducting body can be made of an elastomer which has been made electrically conducting by the addition of conducting material, such as platinum, carbon or silver. Alternatively, the elastic electrically conducting body can consist of a so-called conducting polymer.

According to a fourth conceivable embodiment of the elastic body (not shown), it can be formed of a helically wound spring wire of electrically conducting material and with an elliptical cross section, where the windings of the spring have a substantial angle of inclination towards the longitudinal central axis of the elastic spring, so that the spring can be resiliently compressed somewhat upon compression perpendicular to said longitudinal center axis to thus create many contact points between the matrix disc and the current-transmitting spring body.

Even if the matrix disc is oriented horizontally in the embodiment according to FIG. 1, it can also have an inclined or vertical position during the electroplating process while retaining the above described advantages of the elastic body 36. The unit (a cathode) made up of the detainer ring 28, the matrix disc 16, the elastic body 36 and the current conductor plate 32 can be rotatable or fixed relative to the anode. Within the scope of the invention it is also possible to use more than one elastic body 36, for example a small centrally placed elastic body. It is also conceivable to arrange plural elastic bodies 36 abutting against the two opposite sides of the matrix disc at its outer peripheral area.

I claim:

1. A device for transmitting an electric current to a disk when electroplating the disk, the device comprising at least one closed loop of an elongated, elastic, electrically conductive body that is arranged and constructed to lie in pressural contact with an outer peripheral area of a surface of the disk when electroplating the disk, said body comprising a core of elastic material that is surrounded by at least one layer of a fine net structure of an electrically conductive material.

2. The device of claim 1, wherein said core is solid.

3. The device of claim 1, wherein said core is hollow.

4. The device of claim 1, wherein said core consists of an elastomer.

5. The device of claim 1, wherein said body is substantially circular.

6. The device of claim 1, wherein said body has a circular cross section when unloaded.

7. A device for electroplating a disk in the manufacture of audio and video disks, said device comprising:

a housing for an electrolyte bath;

means for holding a disk in said housing so that a first side of the disk to be electroplated contacts the electrolyte bath;

sealing means for sealing a second side of the disk opposite the first side from the electrolyte bath; and an electric current transmitting loop abutting the disk transmitting an electric current to the disk when the disk is being electroplated, said electric current transmitting loop being sealingly separated from the electrolyte bath, said electric current transmitting loop comprising at least one closed loop of an elongated, elastic, electrically conducting body in contact with an outer peripheral area of the disk, said body comprising a core of an elastic material that is surrounded by at least one layer of fine net structure of electrically conducting material.

8. The device of claim 7, wherein said body is arranged and constructed to resiliently hold the disk axially and radially when electroplating the disk.

9. The device of claim 7, wherein said body is substantially circular.

10. The device of claim 7, wherein said core is solid.

11. The device of claim 7, wherein said core is hollow.

12. The device of claim 7, wherein said core consists of an elastomer.

13. The device of claim 7, wherein said body has a circular cross section when unloaded.

14. The device of claim 7, wherein said sealing means contacts the first side of the disk and said electric current transmitting loop contacts the second side directly opposite said sealing means.

15. A device for electroplating a disk, comprising:

holding means for holding a disk to expose a first side of the disk being held to an electrolytic bath;

an O-ring in said holding means that is arranged and constructed to sealingly engage the first side of a disk being held to prevent leakage of the bath from the first side to a second side of the disk; and an electric current transmission ring in said holding means and directly opposing said O-ring and that is arranged and constructed to contact the second side of a disk being held, said electric current transmission ring being elastically deformable and electrically conducting to transmit an electric current to a disk being held by said holding means, the sealing engagement of said O-ring elastically deforming said electric current transmission ring to maintain continuous contact of said current transmission ring with a disk being held by said holding means, said electric current transmission ring comprising at least one closed loop of an elongated, elastic, electrically conducting body comprising a core of an elastic material that is surrounded by at least one layer of fine net structure of electrically conducting material that is in contact with an outer peripheral area of the second side of the disk being held.

* * * * *